US005860598A

United States Patent [19]

Cruz

[11] Patent Number: 5,860,598

[45] Date of Patent: Jan. 19, 1999

[54] FOG ATOMIZER

[76] Inventor: Luis R Cruz, Cabildo 2349, 1428 Buenos Aires, Argentina

[21] Appl. No.: 917,787

[22] Filed: Aug. 14, 1997

[51] Int. Cl.[6] ..... B05B 7/30

[52] U.S. Cl. ..... 239/346; 239/369; 239/425.5; 239/DIG. 7; 239/428.5

[58] Field of Search ..... 239/424.5, 425.5, 239/340, 343, 346, 369, 425, 590, DIG. 7, 428.5

[56] References Cited

U.S. PATENT DOCUMENTS

| | | | |
|---|---|---|---|
| 2,889,999 | 6/1959 | Tomlinson | 239/428.5 |
| 3,595,480 | 7/1971 | Kunioka | 239/424.5 X |
| 3,735,778 | 5/1973 | Garnier | 239/DIG. 9 X |
| 3,746,071 | 7/1973 | Carlisle | 239/424.5 X |
| 3,790,086 | 2/1974 | Masai | 239/426 X |
| 3,859,205 | 1/1975 | Reba et al. | 239/DIG. 7 X |
| 4,932,591 | 6/1990 | Cruz | 239/498 |
| 5,154,355 | 10/1992 | Gonzalez | 239/425.5 X |

*Primary Examiner*—Kevin Weldon
*Attorney, Agent, or Firm*—James G. O'Neill

[57] ABSTRACT

This invention relates to a device for forming a mist or fog having a convex surface which receives and expands a fluid delivered thereto. The convex surface of the device has a number of circular protrusions spaced peripherally thereon, separated by a number of slots having holes therein. The holes communicate with an inner cylindrical chamber. Suction is produced through the holes when the fluid stream passes over them, to automatically add a further fluid to the fluid being expanded by the device. A cylindrical sleeve surrounds and protects the device. The device is supported in the cylindrical sleeve, either in front of a nozzle by an annular structure, or by a bent tube held in the cylindrical sleeve in front of the device, or in a venturi. When fluid from the nozzle or entering the cylindrical sleeve is expanded by the convex surface, it pulls a further fluid through the slots to mix with the injected fluid separated from the convex surface of the device at greater speed, thus forming a mixed fog of fluid.

10 Claims, 2 Drawing Sheets

1B
1A
1C
R2
R1
α
B
C
G
H
W

FOG ATOMIZER

BACKGROUND OF THE INVENTION

1. Field of the Invention

This invention relates generally to fluid nozzles, and more particularly, to an improved nozzle atomizer system for producing an atomized spray.

2. Description of Related Art

Most of the present known fog or mist nozzles work by providing for the expansion of a fluid, at a certain static pressure to the atmosphere. The fluid normally passes through a nozzle and impacts against grooves placed around the nozzle exit. However, it is known to use other means, such as swirl jet nozzles having filters, where the fluid passes through the nozzles at high pressure. Other known methods use compressed air, steam, or centrifugal force. However, too much energy is required in such known devices, or they are too complicated to be practical.

In the present invention, the fluid is passed over a sphere, having a plurality of circular protrusions placed peripherally thereon at the largest diameter thereof. Furthermore, air is automatically added to the fluid being sprayed, outside of the nozzle, in two basic ways. The first is through holes formed through the sphere, and the second is via air passages formed in an annular structure, supporting a cylindrical sleeve, used to protect an atomizer body.

OBJECTS OF THE INVENTION

It is an object of the present invention to produce high speed flow over circular protrusions, which are placed on the largest diameter of a sphere. A further object of the present invention is to provide slots separating the circular protrusions. A still further object of the present invention is to provide holes in the slots. A yet further object of the present invention is to provide a cylindrical chamber in communication with holes to allow air to be fed into a spayed fluid. A still further object of the present invention is to produce suction over a plurality of holes, when a fluid is expanded over the holes. Yet another object of the present invention is the provision of an external cylindrical sleeve to protect a spherical body having circular protrusions placed thereon. A still further object of the present invention is to provide air passages in an annular structure, which supports a cylindrical sleeve. A particular object of the present invention is to place circular protrusions and slots extending in the same direction as the axis of a sphere and a nozzle, providing flow fluid. A further particular object of the present invention is to place circular protrusions and slots on a spherical atomizer at an angle with respect to the axis of a nozzle. A still further object of the present invention is to provide a portable fog producing device, which produces a large volume of fog. Yet a further particular object of the present invention is to provide a high pressure nozzle which produces suction when passing over an atomizer body. Yet a still further particular object of the present invention is to produce high turbulence in fluid passing over an atomizer body surface. And, it is yet a still further object of the present invention to mix an atomized liquid fluid with turbulent air.

In accordance with one aspect of the invention, there is provided a convex surface over which a flow of expanding fluid from a convergent-divergent nozzle passes. This convex surface has a plurality of circular protrusions formed thereon, separated by a plurality of slots. Holes are formed in the slots and communicate the convex surface to an interior cylindrical chamber, which is at atmospheric pressure. Suction is produced through the holes, when a fluid stream passes over them, so as to automatically add air from the interior chamber to the expanding fluid, over the convex surface. A cylindrical sleeve surrounds the nozzle and convex surface, and is supported by an annular support means, fixed to the external surface of the nozzle. When fluid is discharged from the nozzle, it contacts and quickly diverges from the convex surface, thereby pulling air through air passages formed in the annular support means.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENT

The following description is provided to enable any person skilled in the art to make and use the invention and sets forth the best modes contemplated by the inventor of carrying out his invention. Various modification, however, will remain readily apparent to those skilled in the art, since the generic principles of the present invention have been defined herein specifically to provide for an explanation of an improved fog atomizer column.

A known type of fog atomizer is shown in Applicant's U.S. Pat. No. 4,932,591 ("'591"). The disclosure of this '591 patent is incorporated herein, in its entirety, by this reference thereto.

Figures 1, 1A, 1B, 1C, 1D:
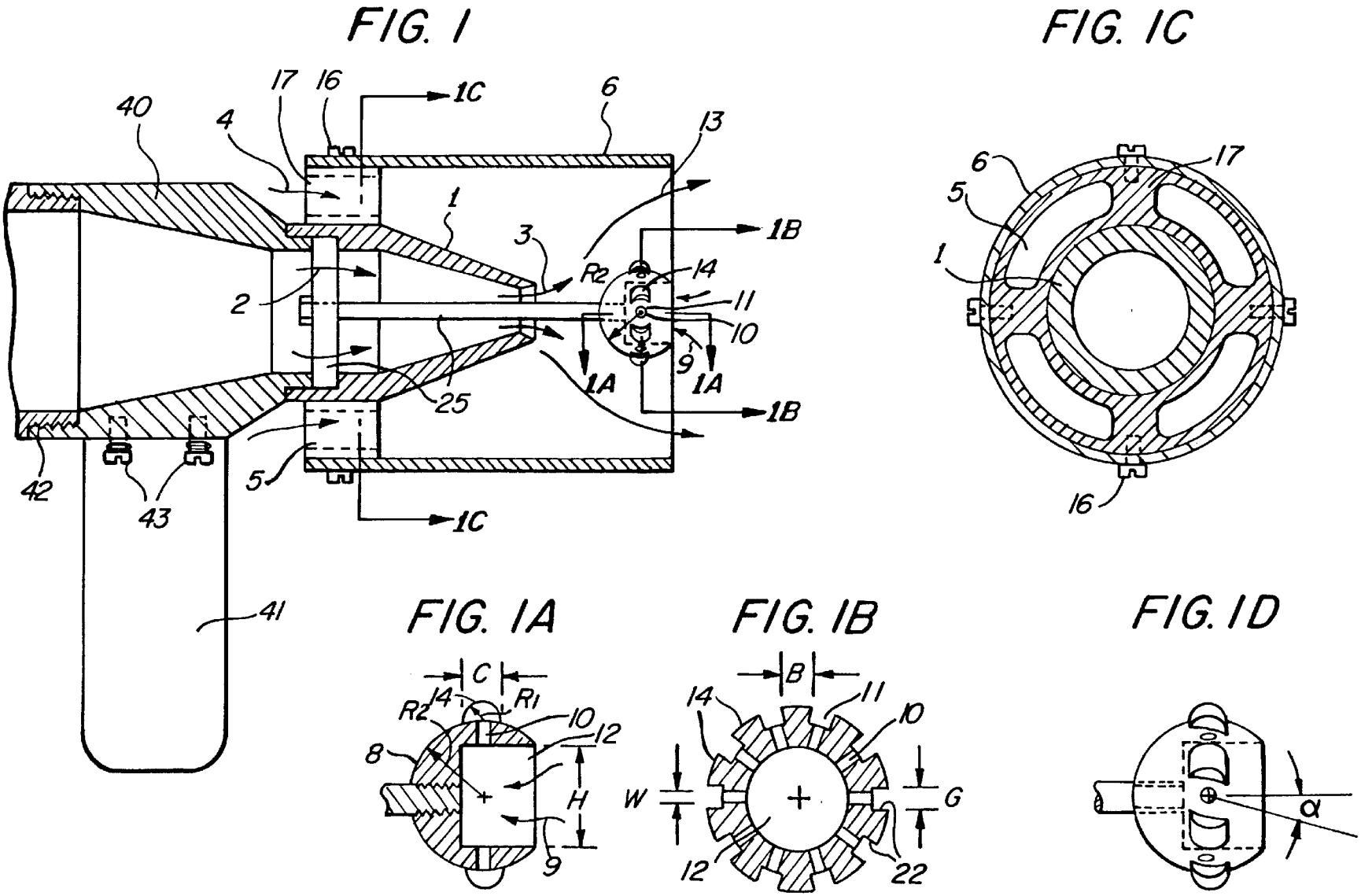
FIG. 1 is a side elevational view of a spherical body having a convex surface with a plurality of circular protrusions formed over its surface; a plurality of slots are formed between the protrusions, and holes are formed in the slots, connected to an interior cylindrical chamber; a nozzle shown in front of the spherical body and a cylindrical sleeve surrounds the nozzle and spherical body.
FIG. 1A is a cross sectional view taken along section line A—A of FIG. 1.
FIG. 1B is a cross sectional view taken along section line B—B of FIG. 1.
FIG. 1C is a cross sectional view taken along section line C—C of FIG. 1.
FIG. 1D is a side elevational view of the spherical body showing the circular protrusions and slots of FIG. 1, formed at an angle with respect to the axis E—E.

Referring now to FIG. 1, there shown is a convergent-divergent nozzle having an angled or divergent forward part 1, held axially aligned with a spherical body 8. The body 8 is spaced from the nozzle 1 a predetermined distance, in order to form a good suction over holes 10 formed therein when a fluid flows 2 over, expands and diverges away from the body 8. The fluid 2 is at a static pressure Ps, that lets it expand to atmospheric pressure after it strikes spherical body 8 and diverges therefrom. The body 8 is held in its axial position, and at a predetermined distance from the exit of nozzle 1 by structural means 25, such as disclosed in the '591 patent. A plurality of circular protrusions 14 are placed around the spherical body 8, along its periphery at its maximum diameter. A plurality of spaces or slots 11 of a wide "G", separate the protrusions 14. The circular protrusions have an upper circular surface of constant radius "R1", and a lower circular surface of a larger radius "R2", as more clearly shown in FIG. 1A. Thus it is obvious that its chord "C" and span "B", as shown in FIG. 1B, from lateral faces 22. The holes 10 in the slots 11 have a diameter "W". The centers of the holes are coincident with the section of maximum diameter of the spherical body 8. The holes 10 are also in communication with a cylindrical inner or interior chamber 12, of a diameter "H", as is shown in FIG, 1A. The interior chamber 12 has a closed inner end and an external or outer end, which is open and in contact with surrounding air 9, which is preferably at atmospheric pressure.

When the fluid 2 exits the nozzle 1, it expands as shown at 3, outside the nozzle, and flows over the spherical body 8, until it reaches the holes 10. Because the fluid is expanding away from the holes 10, a lower pressure or suction is produced, causing exterior air 9, surrounding the body 8 to move toward or into the interior chamber 12, and from there, through the holes 10 to the surface of the spherical body 8, where it is mixed with fluid 13, diverging at great speed from the circular protrusions 14 and slots 11. At the other side of the body 8, towards the nozzle, the expanding fluid 3 pulls air 4 through air passages 5, formed in an annular structure 17, supporting a cylindrical sleeve 6, which completely surrounds the nozzle 1, and the spherical body 8, to protect them from damage. The air entering at 5 is mixed with the sprayed fluid 13, which has diverged at great speed from the body 8. This addition of the air from the air passages 5 and the openings 10 to the sprayed fluid 13, causes a large amount of atomized fluid or fog to be produced.

FIG. 1C shows a cross sectional view of the annular structure 17, which supports the cylindrical sleeve 6, and which is fixed thereto by screws 16. As shown, the air passages 5 are formed in or between annular structures fixed to the external surface of nozzle 1.

FIG. 1D shows a side elevational view of a modified spherical body 8, with the circular protrusions 14 and slots 11 of FIG. 1, being formed at an angle with respect to an axis E—E passing through the nozzle, and the spherical body 8.

The nozzle is shown as being connected to a convergent nozzle 40 having a handle 41, attached thereto by screws 43, held in threads 42 formed at the end of the nozzle 40.

Figure 2:
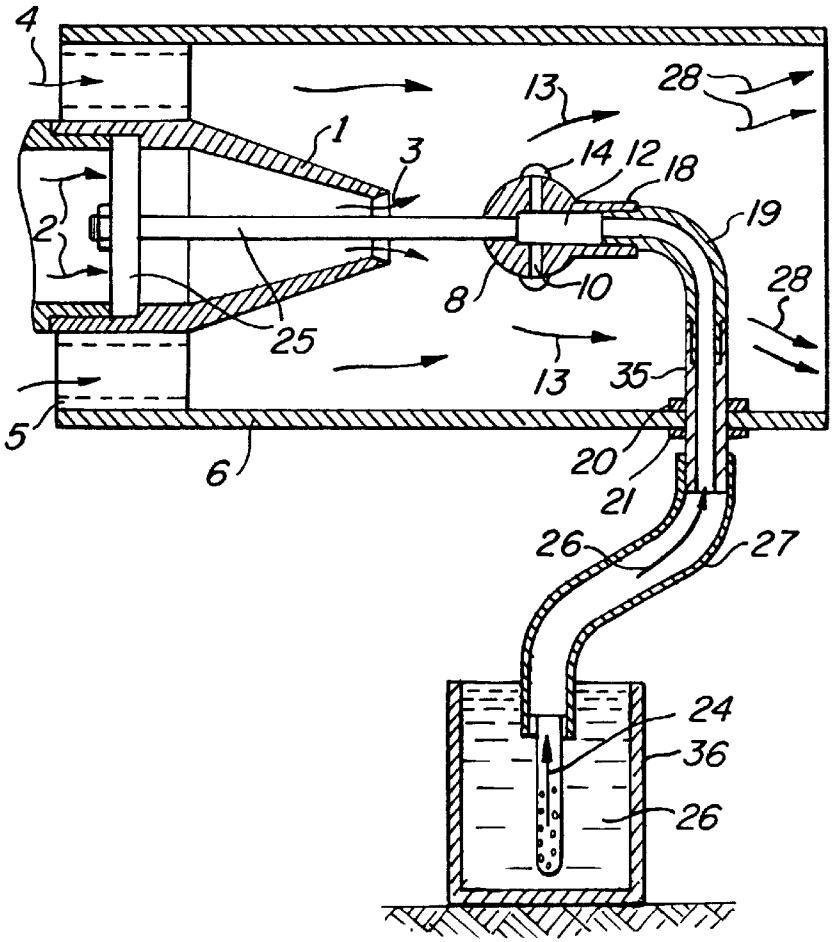
FIG. 2 is a side elevational view of the spherical body of FIG. 1 held in a support tube fixed to the body to support the spherical body in front of the nozzle, in an axial position.

Turning now to FIG. 2, there shown is the same type of atomizer as FIG. 1, except that the spherical body 8 having the circular protrusions 14, slots 11, holes 10 and interior cylindrical chamber 12, also supported by a bent tube 19, inserted and held in a longitudinally extending tubular portion 18, of the interior cylindrical chamber 12. The tube 19 has one end thereof held in an internally threaded portion of 18, by threads formed at the end, so as to support the spherical body 8, in front of the exit of the nozzle 1 at a predetermined distance therefrom, with the axial axis of body 8 coincident with the axial axis of the nozzle 1. Tube 19 includes a second threaded end, which is held in a threaded end of a straight tube 35. A pair of securing means, such as nuts 20 and 21, are screwed onto an externally threaded portion of the straight tube 35 and hold the tubes 19 and 35 in position, fixed to the external cylindrical sleeve 6.

One end of a rubber tube 27 is placed over a non-threaded, free end of the tube 35, outside of the sleeve 6, and the other end of the rubber tube is inserted over a hollow tube 24 having a plurality of openings formed therein. The hollow tube 24 is immersed in a foam solution 26 held in an open container 36. Therefore, when the fluid 2 is expanded, as shown at 3, over the body 8, suction is produced over the holes 10, and since the holes 10 are in communication with the inner cylindrical chamber 12, it is also in communication with the solution 26, in the container 36, which is at atmospheric pressure. The suction at the holes 10 will cause the solution 26 to be drawn upwardly and mixed with the fluid flow coming from the nozzle 1, as well as air coming from the passages 5 inside the cylindrical sleeve 6, to produce a foam emulsion 28. Because the suction on the foam solution 26 is produced outside the nozzle 1, the device of the present invention will work at low, medium and high pressures, which is an improvement over known devices, in which a foam solution is provided from a closed container, different than an open container, such as 36.

Another improvement over known portable mist or fog producing devices is that the present device is held in balance by the spherical body 8. The diameters of the nozzle throat and body 8 may be adjusted, and the angle of the nozzle and the axial position of the body 8 may be changed.

Figure 3:
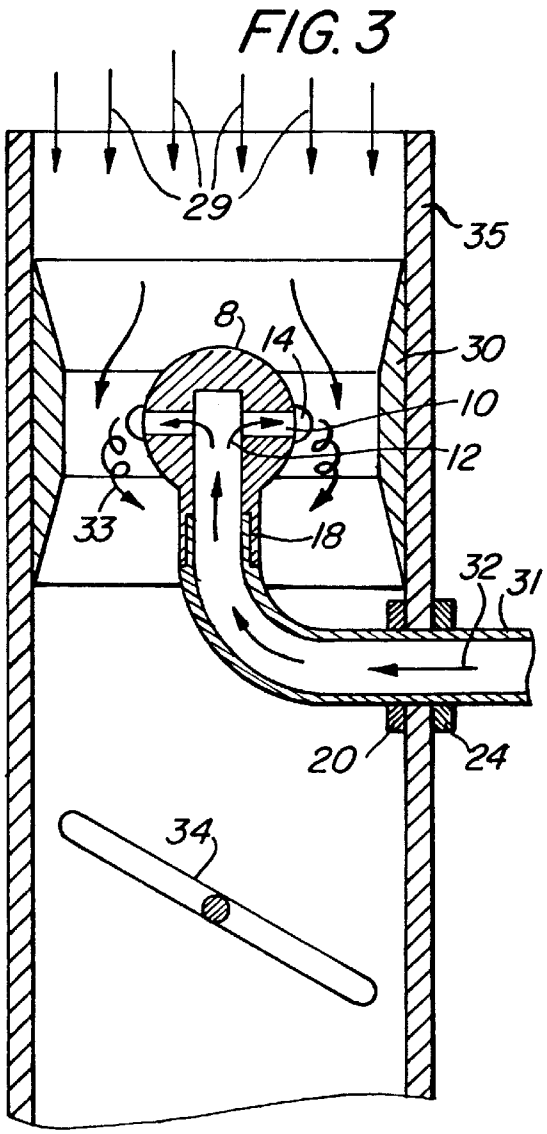
FIG. 3 is a side elevational view of the spherical body of FIG. 2, held inside a venturi tube.

Referring now to FIG. 3, there shown is spherical body 8 with circular protrusions 14, slots 11, holes 10 and inner cylindrical chamber 12, similar to that of FIGS. 1 and 2, without the nozzle, and container 36, held in a venturi tube 30, mounted in a cylindrical tube 35. When air 29, entering tube 35, passes over the holes 10, it produces suction to pull liquid fluid 32, such as gasoline, through inner chamber 12 to mix with turbulent flowing air 33, caused by the circular protrusions 14. A support tube 31 is inserted and held in the longitudinal tubular portion 18, as by threaded means. Nuts 20 and 21 may be screwed onto threads formed on the exterior of the tube 31 to secure tube 31 in place on the cylindrical tube 35. The inner cylindrical chamber 12, is in communication both with the holes 10 and the gasoline, or liquid fluid held in a tank or vessel (not shown), by means of the venturi tube 30 held in the tube 35, and a throttle valve 34, in a known manner. The ratios of the diameters of the body 8 and venturi tube 30 are adjusted to obtain optimum performance.

It thus, can be seen that the novel spherical body of the present invention provides an improved fog or mist atomizer for enhanced production of atomized fluid, unattainable with known devices.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A fog atomizer comprising:

a first body having a plurality of circular protrusions formed therein;

said plurality of circular protrusions spaced peripherally over a section of maximum diameter of said first body;

a cylindrical sleeve having structural means therein holding said first body in axial alignment therein;

an axial axis of said cylindrical sleeve being coincident with an axial axis of said first body;

said first body further including a plurality of slots, having a given width, formed between said plurality of circular protrusions;

a plurality of holes formed in said slots;

an inner cylindrical chamber in said first body;

said plurality of holes having centers which are coincident with the section of maximum diameter of said first body, to said holes communicate said slots with said inner cylindrical chamber, which inner cylindrical chamber has an axis coincident with said axis of said first body;

said inner cylindrical chamber having an inner end which is closed, and an exterior end which is opened, whereby the flow of a fluid in said cylindrical sleeve expands over said first body surface, so as to produce suction over said holes to automatically pull a further fluid from said inner chamber to mix with said fluid in said cylindrical sleeve, which is spaced from said circular protrusions and said slots; and said cylindrical sleeve surrounding said first body.

2. The fog atomizer of claim 1, further including a nozzle in said cylindrical sleeve in front of said first body and in axial alignment therewith; said cylindrical sleeve having a plurality of air passages formed therein and being supported by an annular structure, secured to an external surface of said nozzle, whereby when said fluid is expanded upon exiting from said nozzle and passing over said first body surface, it will pull said further fluid through said plurality of openings.

3. The fog atomizer of claim 2 wherein said plurality of circular protrusions and said plurality of slots are formed at an angle with respect to the axis of said first body and said nozzle.

4. The fog atomizer of claim 3 wherein said structural means is a bent tube, inserted and held in a longitudinally extending tubular portion of said open end of said inner cylindrical chamber to support said first body in front of said nozzle at a predetermined distance therefrom; whereby when said fluid flows from said nozzle it will expand over said first body to produce suction over said holes and pull fluid from said bent tube and through said holes where it is mixed with said fluid in said cylindrical sleeve.

5. The fog atomizer of claim 1 wherein said first body is supported by a bent tube; the position of said first body being coincident with an axis of said bent tube and a venturi tube held in said cylindrical sleeve.

6. The fog atomizer of claim 1 wherein said structural means is a bent tube and said first body is supported by said bent tube in front of a nozzle; the position of said first body being coincident with an axis of said bent tube and said nozzle.

7. A fog atomizer comprising:

a body having a plurality of circular protrusions formed therein;

said plurality of circular protrusions spaced peripherally over a section of maximum diameter of said body;

said body being held in axial alignment by structural means, in front of a convergent-divergent nozzle;

an axial axis of said convergent-divergent nozzle being coincident with an axial axis of said body;

said body further including a plurality of slots, having a width, formed between said plurality of circular protrusions;

a plurality of holes formed in said slots;

an inner cylindrical chamber formed in said body;

said plurality of holes having centers which are coincident with the section of maximum diameter of said body, to said holes communicate said slots with said inner cylindrical chamber, which inner cylindrical chamber has an axis coincident with said body axis;

said inner cylindrical chamber having an inner end which is closed, and an exterior end which is opened, whereby the flow of a fluid coming from said nozzle expands over said body surface, so as to produce suction over said holes, to automatically add a further fluid to a fluid spray from said convergent-divergent nozzle which is spaced from said circular protrusions and said slots; and a cylindrical sleeve surrounding said nozzle and said body; said cylindrical sleeve having a plurality of air passages formed therein and being supported by an annular structure, secured to an external surface of said nozzle, whereby said fluid spray is expanded upon exiting from said nozzle and passing over said body.

8. The fog atomizer of claim 7 wherein said plurality of circular protrusions and said plurality of slots are formed at an angle with respect to the axis of said body and said nozzle.

9. The fog atomizer of claim 7, further including a bent tube, inserted and held in a longitudinally extending tubular portion of said open end of said inner cylindrical chamber to support said body in front of said nozzle at a predetermined distance therefrom; whereby when said fluid spray flows from said nozzle it will expand over said body to produce suction over said holes so as to pull a further fluid from said bent tube and through said holes.

10. A fog atomizer comprising:

a body having a plurality of circular protrusions formed therein;

said plurality of circular protrusions spaced peripherally over a section of maximum diameter of said body;

said body being held in axial alignment by a bent tube in a venturi tube held in a cylindrical sleeve;

an axial axis of said venturi tube being coincident with an axial axis of said body;

said body further including a plurality of slots, having a width, formed between said plurality of circular protrusions;

a plurality of holes formed in said slots;

an inner cylindrical chamber formed in said body;

said plurality of holes having centers which are coincident with the section of maximum diameter of said body, to said holes communicate said slots with said inner cylindrical chamber, which inner cylindrical chamber has an axis coincident with said body axis;

said inner cylindrical chamber having an inner end which is closed and an exterior end which is opened and includes a longitudinally extending tubular portion connected to said bent tube, whereby the flow of a fluid through said venturi tube expands over said body surface, so as to produce suction over said holes, to automatically pull a further fluid through said holes to mix with said fluid, which is detached from said circular protrusions and said slots; and said cylindrical sleeve surrounding said venturi tube and said body.

* * * * *